US008448915B2

(12) United States Patent
Baugh

(10) Patent No.: US 8,448,915 B2
(45) Date of Patent: May 28, 2013

(54) INCREASED SHEAR POWER FOR SUBSEA BOP SHEAR RAMS

(75) Inventor: Benton Frederick Baugh, Houston, TX (US)

(73) Assignee: Recl Power Licensing Corp., Oklahoma, OK (US)

( * ) Notice: Subject to any disclaimer, the term of this patent is extended or adjusted under 35 U.S.C. 154(b) by 114 days.

(21) Appl. No.: 12/930,028

(22) Filed: Feb. 14, 2011

(65) Prior Publication Data

US 2012/0205561 A1 Aug. 16, 2012

(51) Int. Cl.
*E21B 33/06* (2006.01)

(52) U.S. Cl.
USPC ..... 251/1.3; 166/85.4

(58) Field of Classification Search
USPC ..... 251/1.1, 1.3; 60/411, 397; 166/363, 166/364, 85.4
See application file for complete search history.

(56) References Cited

U.S. PATENT DOCUMENTS

| | | | | |
|---|---|---|---|---|
| 2,345,213 | A * | 3/1944 | O'Shei | 60/397 |
| 4,955,195 | A * | 9/1990 | Jones et al. | 60/405 |
| 7,424,917 | B2 * | 9/2008 | Martin | 166/335 |
| 7,735,563 | B2 * | 6/2010 | Judge et al. | 166/357 |
| 2010/0155071 | A1 * | 6/2010 | Gustafson | 166/335 |
| 2012/0103629 | A1 * | 5/2012 | Dietz | 166/376 |

OTHER PUBLICATIONS

"B" Pages From a New York Times Article About Jun. 18, 2010.
"C" Pages of a Cameron Catalog From a 1984-85 Oilfield Composite Catalogs.

* cited by examiner

*Primary Examiner* — John K Fristoe, Jr.
*Assistant Examiner* — Umashankar Venkatesan

(57) ABSTRACT

The method of providing a desired motive force for one or more rams of a subsea blowout preventer as a function of a desired pressure differential across one or more pistons on the subsea blowout preventer when the desired pressure differential is higher than the gauge pressure of the accumulators supplying the pressure, comprising providing one or more pistons connected to the one or more rams, the pistons having a distal side and a proximate side with respect to the rams, providing a first pressure from the accumulators to the distal side of the pistons, providing a tank to contain a second pressure less than the ambient pressure of seawater at the location of the subsea blowout preventer, providing a pressure reducing valve which exhausts into the tank and reduces the pressure on the proximate side of the one or more pistons to proximately the difference between the desired pressure differential and the first pressure further comprising that the pressure differential across the one or more pistons is proximately equal to the maximum working pressure of the one or more cylinders plus an amount to provide a force towards the bore of the blowout preventer stack to offset the force of the pressure in the bore acting on the exposed end of rods of the one or more piston.

7 Claims, 5 Drawing Sheets

INCREASED SHEAR POWER FOR SUBSEA BOP SHEAR RAMS

TECHNICAL FIELD

This invention relates to the general subject connecting a low or negative pressure accumulator to the low pressure side of the pistons operating blowout preventer rams in a high pressure subsea environment to increase the shearing force in a controlled fashion.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

The field of this invention is that of operating blowout preventers in deep water operations to shear pipe within the well bore and to seal the well bore to protect the environment in emergency situations when an obstruction is in the well bore.

Shear rams in blowout preventers are designed to cut the pipe in emergency situations and allow the bore to be closed and secure the well against unintended discharges of oil or gas to the environment. Blind shear rams are designed to both shear the pipe and seal off the well bore in a single movement.

As drill pipe becomes larger in diameter, greater in wall thickness, and higher in yield strength they become more and more difficult to shear. A further complication to this is that when accumulators are used as the power source to do the shearing, less than full accumulator pressure is available when the accumulators discharge enough fluid to move forward and initiate the shearing action. The combination of more difficult to shear pipe and less than full pressure to do the shearing has resulted in the fact that some of the pipes cannot be sheared.

Additional contemporary requirements are that pipe must be sheared with the maximum anticipated pressure in the bore of the BOP Stack. This pressure as high as 15,000 p.s.i. acts on the end of the operating rod pushing the shear rams to the shearing position, cancelling some of the force which was available for the shear rams.

Blowout preventer systems containing these shear rams are major pieces of capital equipment landed on the ocean floor in order to provide a conduit for the drill pipe and drilling mud while also providing pressure protection while drilling holes deep into the earth for the production of oil and gas. The typical blowout preventer stacks have an 18¾ inch bore and are usually of 10,000 or 15,000 psi working pressure. The blowout preventer stack assembly weighs in the range of five hundred to eight hundred thousand pounds. It is typically divided into a lower blowout preventer stack and a lower marine riser package.

The lower blowout preventer stack includes a connector for connecting to the wellhead at the bottom on the seafloor and contains several individual ram type blowout preventer assemblies, which will close on various pipe sizes and in some cases, will close on an open hole with what are called blind rams. Characteristically there is an annular preventer at the top, which will close on any pipe size or close on the open hole.

The lower marine riser package typically includes a connector at its base for connecting to the top of the lower blowout preventer stack, it contains a single annular preventer for closing off on any piece of pipe or the open hole, a flex joint, and a connection to a riser pipe which extends to the drilling vessel at the surface.

The purpose of the separation between the lower blowout preventer stack and the lower marine riser package is that the annular blowout preventer on the lower marine riser package is the preferred and most often used pressure control assembly. When it is used and either has a failure or is worn out, it can be released and retrieved to the surface for servicing while the lower blowout preventer stack maintains pressure competency at the wellhead on the ocean floor.

The riser pipe extending to the surface is typically a 21 inch O.D. pipe with a bore larger than the bore of the blowout preventer stack. It is a low pressure pipe and will control the mud flow which is coming from the well up to the rig floor, but will not contain the 10,000-15,000 psi that the typical blowout preventer stack will contain. Whenever high pressures must be communicated back to the surface for well control procedures, smaller pipes on the outside of the drilling riser, called the choke line and the kill line, provide this function. These will typically have the same working pressure as the blowout preventer stack and rather than have an 18¾-20 inch bore, they will have a 3-4 inch bore. There may be additional lines outside the primary pipe for delivering hydraulic fluid for control of the blowout preventer stack or boosting the flow of drilling mud back up through the drilling riser.

The blowout preventers are operated or closed in response to an electric signal from the surface to an electro-hydraulic control valve which directs fluid stored under pressure in accumulator bottles to the operating cylinders on the blowout preventer. The accumulators are set to or regulated down to the manufacturer's maximum rated working pressure of the hydraulic cylinders which are to provide the force to operate the rams, typically 5000 p.s.i. on deepwater rigs. These pressure regulators presume a large supply of fluids and regulate the pressure downstream of the regulator. Any number of events can prevent this sequence from occurring such as failure in the surface controls to send the signal, failure in the connecting lines from the surface to depth as great as 12,000', failure of the electro-hydraulic valve to close, and absence of fluid stored under pressure.

All subsea blowout preventers have 100% redundant control systems to minimize the risk of non-operation. They are very characteristically called the yellow system and blue system and represent primary and secondary means to operate any function on the blowout preventer stack.

When all else fails, it is not necessary to have emergency operation of multiple components in the subsea blowout preventer stack. A single component—the blind shear rams can immediately secure an uncontrolled flow of oil or gas from the well. A flat faced gate from each side will meet at the middle to seal off the bore. If a pipe of any sort is in the bore at the time, it will simply shear the pipe in half and then seal. The blind shear ram is the ultimate safety device, but it must operate. Unfortunately, contemporary rams will not shear every kind of pipe in half, but are rather limited to shearing the smaller drill pipe bodies. Larger cross section and higher strength materials provide limitations on contemporary devices, providing situations in which the safety devices simply will not close.

The need to be able to send a single command which will quickly secure the well bore against discharges to the environment has long been known in the industry as indicated by a test demonstration of shearing a drill collar at the Offshore Technology Conference in Houston more than 20 years ago. Since this demonstration of the desire for this to be accomplished, manufacturers have not accomplished this, but rather have settled back in a mode of building systems which in some cases will shear only the drill pipe body and the tool joint, and in some cases the products offered will only shear the drill pipe body and will not shear the drill pipe tool joint. The need for this level of safety has long been known, and industry has simply not figured out how to practically achieve this.

BRIEF SUMMARY OF THE INVENTION

The object of the present invention is to provide greater force for shearing pipe within the bore of a subsea blowout preventer stack than would be available based upon the pressure of the powering fluids in the accumulators.

The second object of the present invention is to control the force for shearing pipe within the bore of a subsea blowout preventer stack to be approximately the force which would be available if the accumulators had remained charged at the full working pressure of the operating cylinders on the subsea blowout preventer stack.

A third objective of the present invention is to provide a system which provides a pressure differential across the pistons of a shear ram blowout preventer which exceeds the supply pressure from the accumulators which is powering it.

Another objective of the present invention is to provide a system which will provide full working pressure differential of the operating cylinders to shear the drill pipe even when the accumulator pressure has declined due to partial discharge of the accumulators.

Another objective of the present invention is to provide a system which will provide a greater than full working pressure differential of the operating cylinders to shear the drill pipe even when the accumulator pressure has declined due to partial discharge of the accumulators and when there is a differential pressure in the bore of the blowout preventer stack which tends to offset the force of the pistons.

DETAILED DESCRIPTION OF THE INVENTION

Figure 1:
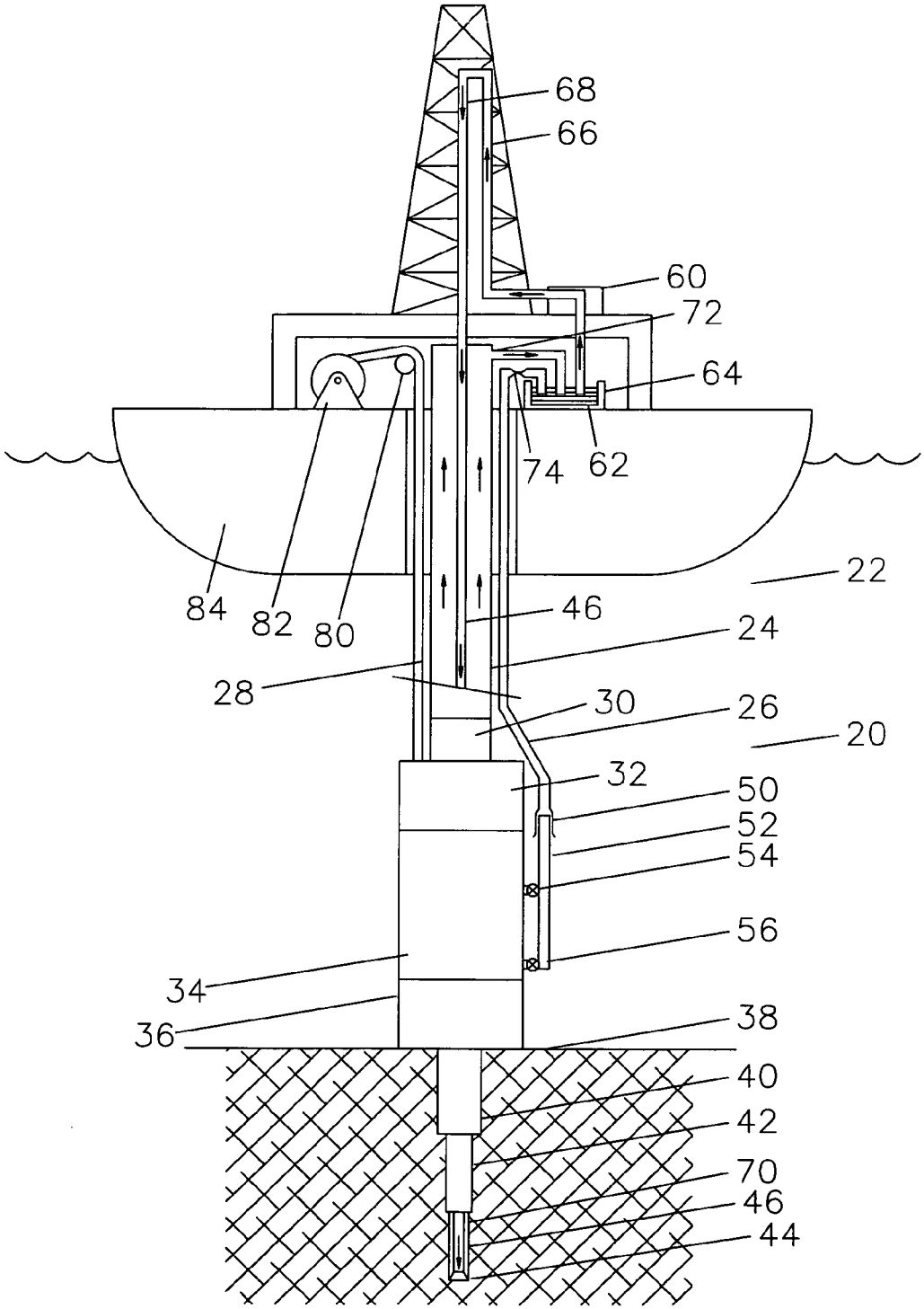
FIG. 1 is a view of a deepwater drilling system such as would use this invention.

Referring now to FIG. 1, a view of a complete system for drilling subsea wells 20 is shown in order to illustrate the utility of the present invention. The drilling riser 22 is shown with a central pipe 24, outside fluid lines 26, and cables or hoses 28.

Below the drilling riser 22 is a flex joint 30, lower marine riser package 32, lower blowout preventer stack 34 and wellhead 36 landed on the seafloor 38.

Below the wellhead 36, it can be seen that a hole was drilled for a first casing string, that string 40 was landed and cemented in place, a hole drilled through the first string for a second string, the second string 42 cemented in place, and a hole is being drilled for a third casing string by drill bit 44 on drill string 46.

The lower Blowout Preventer stack 34 generally comprises a lower hydraulic connector for connecting to the subsea wellhead system 36, usually 4 or 5 ram style Blowout Preventers, an annular preventer, and an upper mandrel for connection by the connector on the lower marine riser package 32.

Below outside fluid line 26 is a choke and kill (C&K) connector 50 and a pipe 52 which is generally illustrative of a choke or kill line. Pipe 52 goes down to valves 54 and 56 which provide flow to or from the central bore of the blowout preventer stack as may be appropriate from time to time. Typically a kill line will enter the bore of the Blowout Preventers below the lowest ram and has the general function of pumping heavy fluid to the well to overburden the pressure in the bore or to "kill" the pressure. The general implication of this is that the heavier mud will not be circulated, but rather forced into the formations. A choke line will typically enter the well bore above the lowest ram and is generally intended to allow circulation in order to circulate heavier mud into the well to regain pressure control of the well.

Normal drilling circulation is the mud pumps 60 taking drilling mud 62 from tank 64. The drilling mud will be pumped up a standpipe 66 and down the upper end 68 of the drill string 46. It will be pumped down the drill string 46, out the drill bit 44, and return up the annular area 70 between the outside of the drill string 46 and the bore of the hole being drilled, up the bore of the casing 42, through the subsea wellhead system 36, the lower blowout preventer stack 34, the lower marine riser package 32, up the drilling riser 22, out a bell nipple 72 and back into the mud tank 64.

During situations in which an abnormally high pressure from the formation has entered the well bore, the thin walled central pipe 24 is typically not able to withstand the pressures involved. Rather than making the wall thickness of the relatively large bore drilling riser thick enough to withstand the pressure, the flow is diverted to a choke line or outside fluid line 26. It is more economic to have a relatively thick wall in a small pipe to withstand the higher pressures than to have the proportionately thick wall in the larger riser pipe.

When higher pressures are to be contained, one of the annular or ram Blowout Preventers are closed around the drill pipe and the flow coming up the annular area around the drill pipe is diverted out through choke valve 54 into the pipe 52. The flow passes up through C&K connector 50, up pipe 26 which is attached to the outer diameter of the central pipe 24, through choking means illustrated at 74, and back into the mud tanks 64.

On the opposite side of the drilling riser 22 is shown a cable or hose 28 coming across a sheave 80 from a reel 82 on the vessel 84. The cable or hose 28 is shown characteristically entering the top of the lower marine riser package. These cables typically carry hydraulic, electrical, multiplex electrical, or fiber optic signals. Typically there are at least two of these systems for redundancy, which are characteristically painted yellow and blue. As the cables or hoses 28 enter the top of the lower marine riser package 32, they typically enter the top of a control pod to deliver their supply or signals. When hydraulic supply is delivered, a series of accumulators are located on the lower marine riser package 32 or the lower Blowout Preventer stack 34 to store hydraulic fluid under pressure until needed.

Figure 2:
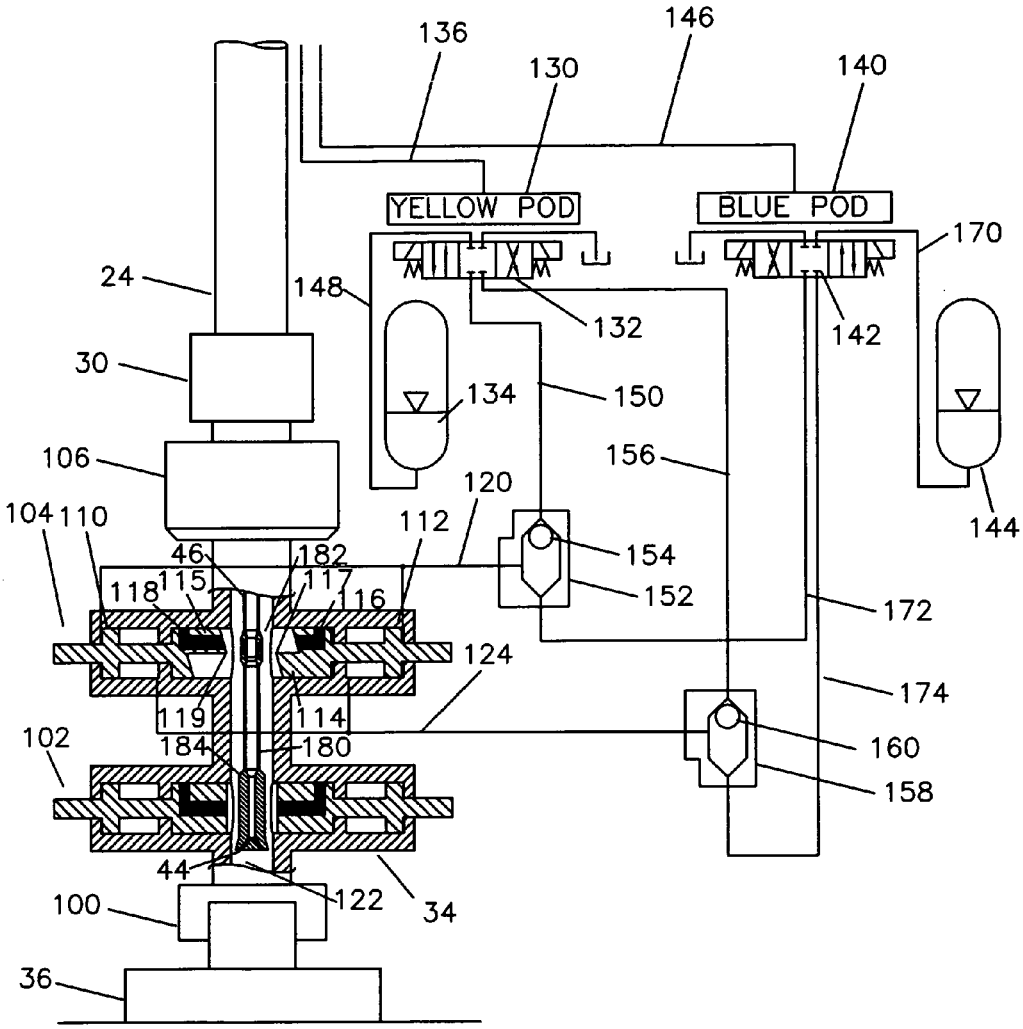
FIG. 2 is a schematic of a portion of a blowout preventer stack illustrating how the yellow and blue control pods direct operating fluids from pressurized accumulators to the function to be actuated, illustrating various items which might be in the well bore when closure is needed, and illustrating shear rams which are intended to cut the items in the well bore.

Referring now to FIG. 2, portion of the complete system for drilling subsea wells 20 is shown in greater detail for better clarity and shows a conventional dual pod (yellow and blue) control system. Connector 100 at the bottom is hydraulically operated to provide a connection between the lower blowout preventer stack 34 and the subsea wellhead system 36 as shown in FIG. 1. Ram type blowout preventers are shown at 102 and 104 and an annular blowout preventer is shown at 106. An annular blowout preventer is basically a ring of rubber which is pushed into the bore to seal the bore or on anything in the bore, but is not presently under consideration.

Ram type blowout preventer 104 has pistons 110 and 112 connected to rams 114 and 115 respectively. Ram 114 has seal element 116 and shear blade portion 117. Ram 115 has seal element 118 and shear blade portion 119. When pressure and flow are introduced into line 120, the pistons and rams move toward one another and sealingly engage in the center of the bore 122. When rams 114 and 115 are appropriately constructed, they will shear pipe which is within bore 122 and then seal across the bore. When pressure and flow are introduced into line 124 the pistons 110 and 112 along with rams 114 and 115 move away (retract) from each other until the bore 122 is unobstructed.

The yellow pod control system 130 is shown with a single valve 132, pressure supply from accumulator 134, and control wire or umbilical 136 going to the surface vessel. The blue pod control system 140 is an exact duplicate for the yellow pod control system 130, except for the color. It shows a single valve 142, pressure supply from an accumulator 144, and control wire or umbilical 146 going to the surface. Control valves 132 and 142 are illustrative of dozens of similar valves in each of the control pods for various functions.

When control valve 132 is shifted to the right and pressure line 148 communicates with line 150, it supplies pressure and flow to shuttle valve 152, moving the internal ball 154 opposite the position as shown directing the fluid to line 120 to push rams 114 and 115 into the bore 122 to shear pipe in the well and seal across the bore. When control valve 132 is shifted to the left and pressure line 148 communicates with line 156, it supplies pressure and flow to shuttle valve 158, moving the internal ball 160 to the position opposite the position as shown directing the fluid to line 120 to retract rams 114 and 115 out of the center of bore 122.

Similarly, when control valve 142 is shifted to the right and pressure line 170 communicates with line 172, it supplies pressure and flow to shuttle valve 152, moving the internal ball 154 to the position as shown directing the fluid to line 124 to push rams 114 and 115 into the bore 122 to shear pipe in the well and seal across the bore. When control valve 142 is shifted to the left and pressure line 170 communicates with line 174, it supplies pressure and flow to shuttle valve 158, moving the internal ball 160 to the position as shown directing the fluid to line 124 to retract rams 114 and 115 out of the center of bore 122.

Within bore 122 a drill string 46 is shown with bit 44 at the bottom. Drill pipe body 180 is illustrative of the majority of the drill string and will typically be of high grade steel of 5.5 inch O.D. and 0.5 or 0.6 wall thickness. All conventional shear rams will shear the drill pipe body 180. Tool joint 182 is a threaded section connecting 30 foot sections of drill pipe body together. The tool joint 182 is always thicker in cross section and is frequently of higher strength steel. Some conventional shear rams will shear a tool joint and some will not. Due to the relative length of the drill pipe body sections and the length of the tool joints, there is about 1 chance in 30 of hitting a tool joint. In calm times the footage of the pipes in the well bore can be calculated to minimize the risk. In emergency situations, these calculations may not be able to be made and the operator must simply close hoping to miss a tool joint.

Drill collars 184 immediately above the bit 44 are 30 foot long sections of small I.D. and large O.D. tubes for the purpose of concentrating weight on the bit to enhance drilling. If the drill collars are in the way of the shear rams at the time of emergency closure, none of the conventional rams will shear the drill collars.

The primary reason for the inability to shear the thicker cross section is the limited force generated by the pressure in line 120 pushing on the piston area of the pistons 110 and 112. The piston area is typically limited by the general geometry of the assembly.

Figure 3:
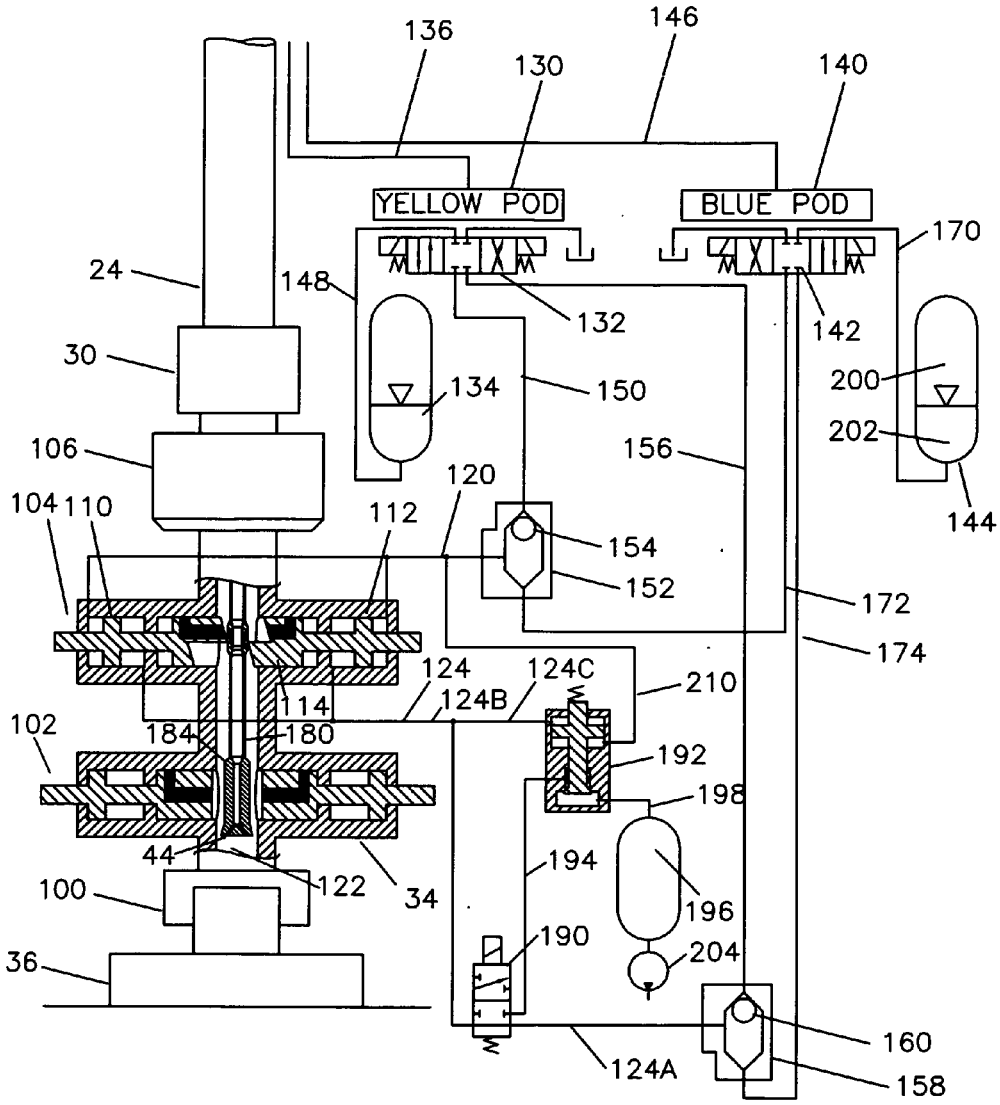
FIG. 3 is a schematic similar to FIG. 2 showing the negatively charged accumulator and pressure reducing valve of this invention added to the system.

Referring now to FIG. 3, a valve 190 has been introduced into line 124 dividing it into lines 124A and 124B. Pressure reducing valve 192 is connected to valve 190 by line 194. Whereas a pressure regulator is a valve which controls the pressure downstream of the valve, a reducing valve is a valve which controls the pressure upstream of the valve.

Negative accumulator 196 is connected to pressure reducing valve 192 by line 198. It should be noted that negative accumulator 196 does not have the internal symbols of an accumulator indicating a division of the nitrogen gas 200 and control liquid 202 as is seen in accumulators 144 and 134. Negative accumulator 196 can be simply an empty bottle with atmospheric pressure in it or can have an internal pressure higher or lower than atmospheric pressure, but less than the anticipated ambient pressure at the working depth. If we are drilling in 7000 foot seawater depth, the water (ambient) pressure is 7000*0.465 p.s.i./ft. or 3255 p.s.i. Relatively speaking, the negative accumulator has a pressure 3255 p.s.i. lower than subsea ambient, or 3255 p.s.i., but does not impact the operation of the system when valve 190 is in the position as shown in FIG. 3.

Pump 204 can be utilized to empty any fluids which enter negative accumulator 196 during operations.

Figure 4:
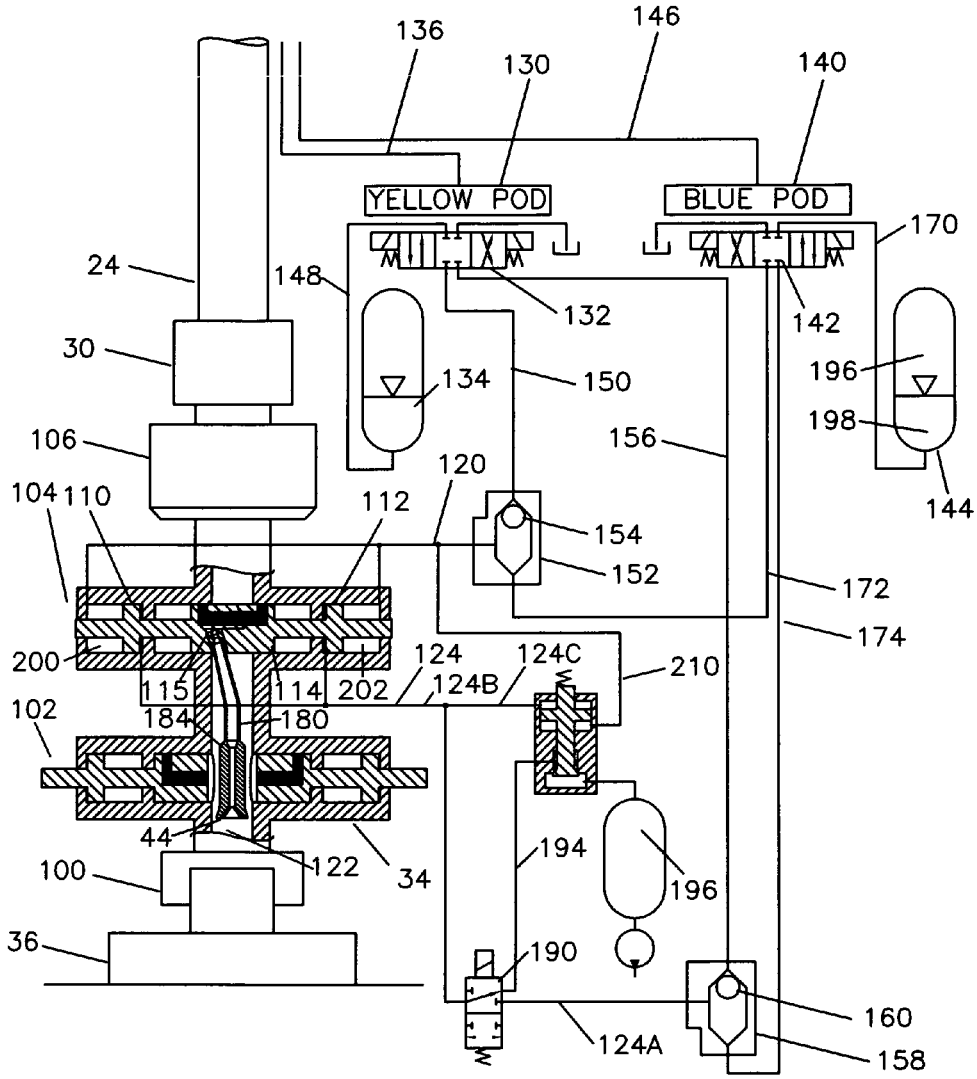
FIG. 4 is a schematic similar to FIG. 3 showing the negatively charged accumulator and pressure reducing valve with the pressure reducing valve being shown actuated and controlling the differential pressure across the operating pistons.

Referring now to FIG. 4, when valve 132 or valve 142 directs the pressure from accumulator 134 or 144 respectively to line 120 the rams 114 and 115 are pushed forward by the force of the fluid on sides 200 and 202 of the piston 110 and 112 respectively. The magnitude of the force is the 5000 p.s.i. differential of the fluid from the accumulator to ambient across the piston area, or less as the accumulator pressure declines due to the discharge of fluid.

If this force is not adequate to shear the pipe, valve 190 can be actuated to the position as shown to block line 124*a* and communicate with line 194 and therefore to pressure reducing valve 192. Pressure reducing valve 192 is sensitive to the pressure in line 120 which moves the rams toward the bore 122 via line 210 and to the pressure in line 124 which tends to move the rams away from bore 122 via line 124C. When the piston areas of the pressure reducing valve 192 and the piston areas of the pistons 110 and 112 are properly sized, the pressure in line 194 and therefore in line 124B will be reduced to approximately 5000 p.s.i. below the pressure in line 120, to give a full 5000 p.s.i. differential across pistons 110 and 112. In this way the full manufacturer's rating of the system can be taken advantage of for maximum force even when the accumulator supply pressure is declining.

An example of these pressures would be:

| ENGAGE PRESSURE (120) | RETRACT PRESSURE (124) |
|---|---|
| 5000 p.s.i. | 0 p.s.i. |
| 4000 p.s.i. | −1000 p.s.i. |

By reducing the pressure in line 124 going into an empty accumulator bottle to below the ambient pressure, functionally a negative pressure of −1000 p.s.i. (relative to ambient conditions) is caused and compensated for the accumulator pressure declining to 4000 p.s.i.

Figure 5:
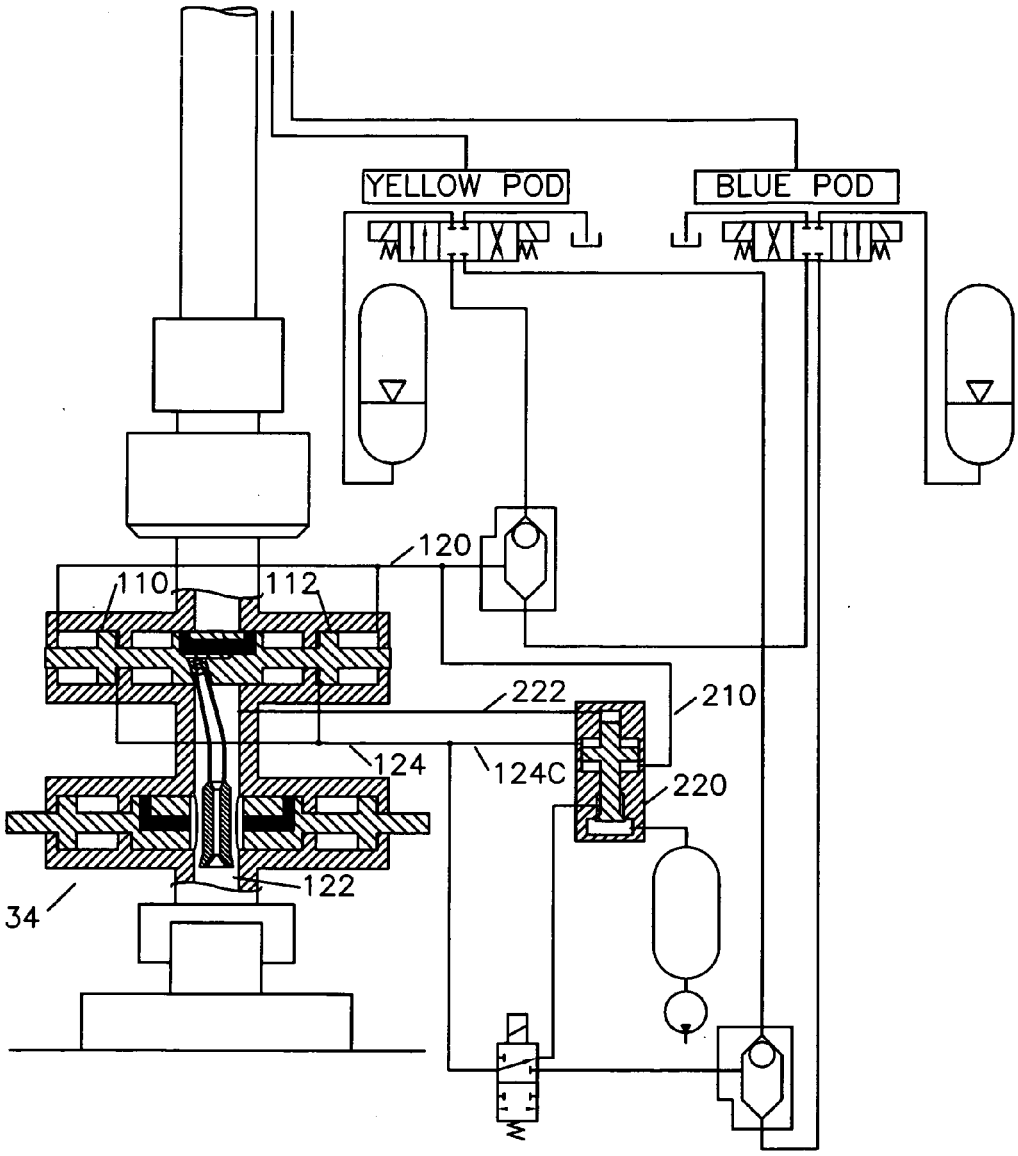
FIG. 5 is an arrangement similar to FIG. 4 with an additional input from the bore pressure of the blowout preventer stack to the pressure reducing valve to allow the pressure differential to compensate for the effect of bore pressure on the actuating rod.

Referring now to FIG. 5, pressure reducing valve 220 is sensitive to the pressure in line 120 which moves the rams toward the bore 122 via line 210, to the pressure in line 124 which tends to move the rams away from bore 122 via line 124C, and to the pressure in the bore 122 of the blowout preventer stack 34 via line 222. In this way the pressure reducing valve produces a pressure differential across pistons 110 and 112 which provides the full force of the manufacturer's maximum pressure differential, i.e. 5000 p.s.i. plus an additional force to offset the counteracting force for potential pressure in the well bore 122. When attempting to shear thick wall pipe, this provides the maximum force which the manufacturer will allow to be exerted on the shear ram blades, even when accumulator pressure is declining and when there is offsetting pressure in the bore.

As is well know in the art, lines 210, 124C, and 222 which are indicated to be hydraulic lines can well be representative of a hydraulic signal to a pressure transducer and then an electric line running to actually operate the pressure reducing valve.

An example of these pressures would be:

| ENGAGE (120) | BORE (222) | RETRACT (124) |
|---|---|---|
| 5000 p.s.i. | 0 p.s.i. | 0 p.s.i. |
| 4000 p.s.i. | 0 p.s.i. | −1000 p.s.i. |
| 5000 p.s.i. | 10000 p.s.i. | −500 p.s.i. |
| 4000 p.s.i. | 10000 p.s.i. | −1500 p.s.i. |

The −1000 p.s.i. compensates again for the pressure in the accumulator declining and the −500 p.s.i. compensates for the bore pressure force against the end of the rod. The −1500 p.s.i. is the combination of these factors. The reason that in this example only −500 p.s.i. is required to compensate for the 10,000 p.s.i. bore pressure is the relative size of the piston and the rod connected to the piston.

The non-obviousness of this invention is clearly demonstrated by the need for enhanced safety in emergency situations, the extended period over which the need has been known, and the lack of recognition of this solution to the problem.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. The method of providing a force for shearing pipe within the bore of a blowout preventer which is located in a subsea location and is subjected to seawater pressure, comprising Providing one or more shear rams for shearing said pipe, Providing one or more pistons in one or more cylinders to provide the force for shearing said pipe when pressure is introduced onto a first side of said pistons, said cylinders having a maximum working pressure Providing a hydraulic supply for said pistons coming at least in part from one or more accumulators, Drawing fluid from said one or more accumulators at a current pressure which does not exceed said maximum working pressure and which declines in pressure to less than said maximum working pressure as said fluid is drawn out, Providing one or more low pressure reservoirs for fluid which are pressured to a pressure lower than said seawater pressure, Providing a valve connected to the second side of said one or more pistons to said one or more low pressure reservoirs which reduces the pressure on said second side of said one or more pistons to increase the pressure differential across said one or more pistons, and further comprising that said pressure differential across said one or more pistons is proximately equal to the maximum working pressure of said one or more cylinders plus an amount to provide a force towards said bore of said blowout preventer stack to offset the force of the pressure in the bore acting on the exposed end of rods of said one or more piston.

2. The method of providing a desired motive force for one or more rams of a subsea blowout preventer as a function of a desired pressure differential across one or more pistons on said subsea blowout preventer when said desired pressure differential is higher than the gauge pressure of the accumulators supplying the pressure, comprising providing one or more pistons connected to said one or more rams, said pistons having a distal side and a proximate side with respect to said rams, providing a first pressure from said accumulators to said distal side of said pistons, providing a tank to contain a second pressure less than the ambient pressure of seawater at the location of said subsea blowout preventer, providing a valve which exhausts into said tank and reduces the pressure on the proximate side of said one or more pistons, and further comprising providing said valve with a control piston and connecting pressure at said distal side to one side of said control piston, and connecting pressure at said proximate side to an opposite side of said control piston.

3. The method of providing a desired motive force for one or more rams of a subsea blowout preventer as a function of a desired pressure differential across one or more pistons on said subsea blowout preventer when said desired pressure differential is higher than the gauge pressure of the accumulators supplying the pressure, comprising providing one or more pistons connected to said one or more rams, said pistons having a distal side and a proximate side with respect to said rams, providing a first pressure from said accumulators to said distal side of said pistons, providing a tank to contain a second pressure less than the ambient pressure of seawater at the location of said subsea blowout preventer, providing a valve which exhausts into said tank and reduces the pressure on the proximate side of said one or more pistons to proximately the difference between said desired pressure differential and said first pressure further comprising that said pressure differential across said one or more pistons is proximately equal to the maximum working pressure of said one or more cylinders plus an amount to provide a force towards said bore of said blowout preventer stack to offset the force of the pressure in the bore acting on the exposed end of rods of said one or more piston.

4. The method of claim 3, further comprising said desired motive force is the maximum pressure allowable said pistons on said subsea blowout preventer.

5. The method of claim 3 further comprising said one or more rams are shear rams which will shear pipe within said bore of said subsea blowout preventer.

6. The method of claim 5 further comprising said one or more rams will sealingly block said bore of said subsea blowout preventer.

7. The method of claim 3 further comprising communicating said first pressure which is higher than said ambient pressure to said distal side of said one or more pistons to increase the force said one or more pistons exerts on said one or more rams.

* * * * *